US011680304B2

(12) United States Patent
Xu et al.

(10) Patent No.: US 11,680,304 B2
(45) Date of Patent: Jun. 20, 2023

(54) METHOD FOR REDUCING AND HOMOGENIZING RESIDUAL STRESS OF A METAL FRAME BASED ON ELASTIC ACOUSTIC WAVES

(71) Applicant: BEIJING INSTITUTE OF TECHNOLOGY, Beijing (CN)

(72) Inventors: Chunguang Xu, Beijing (CN); Wenyuan Song, Beijing (CN); Peilu Li, Beijing (CN); Yuren Lu, Beijing (CN); Peng Yin, Beijing (CN); Shuangyi Li, Beijing (CN)

(73) Assignee: BEIJING INSTITUTE OF TECHNOLOGY, Beijing (CN)

( * ) Notice: Subject to any disclaimer, the term of this patent is extended or adjusted under 35 U.S.C. 154(b) by 0 days.

(21) Appl. No.: 17/337,756

(22) Filed: Jun. 3, 2021

(65) Prior Publication Data

US 2022/0025481 A1 Jan. 27, 2022

(30) Foreign Application Priority Data

Jul. 23, 2020 (CN) ..... 202010718716.0

(51) Int. Cl.
*C21D 10/00* (2006.01)

(52) U.S. Cl.
CPC ..... *C21D 10/00* (2013.01)

(58) Field of Classification Search
CPC ..... C21D 10/00
See application file for complete search history.

(56) References Cited

U.S. PATENT DOCUMENTS

2004/0250584 A1* 12/2004 Offer ..... C21D 7/04 72/56

FOREIGN PATENT DOCUMENTS

| | | | |
|---|---|---|---|
| CN | 103045845 | A | 4/2013 |
| CN | 103076821 | A | 5/2013 |
| CN | 104388851 | A | 3/2015 |

(Continued)

OTHER PUBLICATIONS

Machine translation of CN109680141A (Year: 2019).*
Machine translation of CN107297405B (Year: 2019).*

*Primary Examiner* — Anthony J Zimmer
*Assistant Examiner* — Nazmun Nahar Shams
(74) *Attorney, Agent, or Firm* — Shumaker, Loop & Kendrick, LLP; John A. Miller

(57) ABSTRACT

A method for reducing and homogenizing residual stress of a metal frame based on elastic acoustic waves that includes determining an injection scheme of elastic acoustic waves based on residual stress distribution and material characteristics of a metal frame, where the injection scheme comprises at least one of the number of injection directions and corresponding injection direction(s), an excitation scheme and working parameters of the elastic acoustic waves; placing the metal frame in a substrate and fixing the inner and outer frames of the metal frame; assembling an excitation device for the elastic acoustic waves based on the determined excitation scheme of the elastic acoustic waves; injecting the acoustic waves into the metal frame from at least one direction; and performing the reduction and homogenization for multiple rounds if the reduction and homogenization of the residual stress of the metal frame in a single round does not meet the requirement.

3 Claims, 2 Drawing Sheets

(56) References Cited

FOREIGN PATENT DOCUMENTS

| | | | |
|---|---|---|---|
| CN | 109680141 | A | 4/2019 |
| JP | H10305315 | A | 11/1998 |

* cited by examiner

METHOD FOR REDUCING AND HOMOGENIZING RESIDUAL STRESS OF A METAL FRAME BASED ON ELASTIC ACOUSTIC WAVES

CROSS-REFERENCE TO RELATED APPLICATIONS

This application claims priority to China Patent Application Serial No. 202010718716.0 filed Jul. 23, 2020, the entire disclosure of which is herein incorporated by reference.

BACKGROUND

Field

The invention relates to the field of metal frame processing, and in particular to a method for reducing and homogenizing residual stress of a metal frame based on elastic acoustic waves.

Discussion of the Related Art

Titanium alloys are widely used in the aerospace field due to their excellent mechanical properties, but they are difficult to be processed due to their small elastic modulus and low thermal conductivity. A non-uniform residual stress field is inevitably introduced into a workpiece after the processes of milling, linear cutting and the like, when a small thin-wall frame component is machined and prepared. The forged titanium alloy blank itself contains residual stress to a certain degree after being prepared. After the residual stress is superposed with a residual stress field generated after processing, the titanium alloy blank causes deformation at the position of the residual stress concentration, which will seriously affect the mechanical property and the fatigue life of a component during the subsequent assembly and service process.

Traditional methods for reducing residual stress of metal components include natural aging, stress relief annealing, vibration aging, ultrasonic impact, and the like. The natural aging method is less efficient, takes up a large amount of space for a long time, and has been gradually eliminated. The stress relieving annealing method has strict requirements on the process. If the cooling rate and annealing temperature are not properly treated, additional residual stress will be introduced and the energy consumption will be high. The vibration aging method can effectively eliminate residual stress, but has a limitation in that it cannot be well applied to components with variable cross sections, variable thicknesses and holes, causing large noise in the control field. During the process of reducing stress, the ultrasonic impact method may cause microcrack damage to the metal surface and cannot control the internal residual stress state, thereby greatly limiting its practical applications.

Therefore, the disclosure provides a method for reducing and homogenizing residual stress of a metal frame based on elastic acoustic waves. The method can efficiently homogenize and reduce overlarge residual stress values without damaging the metal frame, and prevent the deformation of components during the subsequent assembly and service process.

SUMMARY

In view of the above problems, the present disclosure provides a method for reducing and homogenizing residual stress of a metal frame based on elastic acoustic waves. The method includes determining an injection scheme of elastic acoustic waves based on residual stress distribution and material characteristics of a metal frame, where the injection scheme at least comprises one of the number of the injection directions and corresponding injection direction(s), an excitation scheme and working parameters of the elastic acoustic waves. The method further includes placing the metal frame in a substrate and fixing inner and outer frames of the metal frame, assembling an excitation device for the elastic acoustic waves based on the determined excitation scheme of the elastic acoustic waves, and injecting the elastic acoustic waves into the metal frame from at least one direction based on the determined working parameters of the elastic acoustic waves to perform reduction and homogenization of residual stress of the metal frame.

From the above, the metal frame is fixed in the device tool to prevent the metal frame from deforming during the injection of the elastic acoustic waves. The elastic acoustic waves are injected from at least one direction, based on the residual stress distribution of the metal frame. The energy superposition of the elastic acoustic waves is realized in the metal frame when the elastic acoustic waves are injected from more than one direction, so that the residual stress of the metal frame is efficiently and nondestructively reduced and homogenized, where the reduction and homogenization are performed for multiple rounds when it is determined that the reduction and homogenization of the residual stress of the metal frame does not meet a requirement.

From the above, in order not to damage the stiffness of the metal frame, it is necessary to control the amplitude and the injection duration of the elastic acoustic waves. The reduction and homogenization are performed for multiple rounds when the reduction and homogenization of the residual stress of the metal frame in a single round does not meet the requirement. The injection direction(s) of the elastic acoustic waves is aligned with position(s) to be controlled of the residual stress of the metal frame, and the number of injection directions of the elastic acoustic waves is set to be larger than one when one of the following conditions is met. There is more than one position to be controlled for the residual stress of the metal frame, and one injection direction cannot cover the positions to be controlled of the total residual stress, and the residual stress of the metal frame at a single position to be controlled requires the elastic acoustic waves to be injected from more than one direction.

From the above, based on the residual stress distribution of the metal frame, elastic acoustic waves are injected from multiple directions so as to achieve the reduction and homogenization of residual stress at multiple positions to be controlled at the same time, or to realize the energy superposition of multiple elastic acoustic waves in a single position to be controlled for reducing and homogenizing the residual stress of the metal frame. The excitation scheme of the elastic acoustic waves includes using an ultrasonic vibrator as the excitation device for the elastic acoustic waves, selecting an ultrasonic horn of the ultrasonic vibrator based on an acoustic velocity of the metal frame, and determining whether a tool cap needs to be added, based on a size of the position(s) to be controlled of the residual stress of the metal frame.

Furthermore, the excitation scheme of the elastic acoustic waves further also includes using a fluid coupling excitation device as the excitation device for the elastic acoustic waves, and forming guided waves at the position(s) to be controlled of the metal frame by adjusting the injection direction(s) of the elastic acoustic waves.

From the above, when an ultrasonic vibrator is used as the excitation device for the elastic acoustic waves, the injection angle of the elastic acoustic waves cannot be changed, and it is mainly determined how the type of the amplitude transformer is selected and whether a tool cap matches the size of the position to be controlled. When a fluid coupling excitation device is used as the excitation device for the elastic acoustic waves, the injection angle of the elastic acoustic waves can be adjusted after the assembly is completed, so that guided waves are formed in the metal frame to realize the energy superposition. The working parameters of the elastic acoustic waves at least comprise one of a frequency, an amplitude, a phase and an injection duration.

From the above, the frequency of the elastic acoustic waves is generally determined based on the material of the metal frame. The amplitude of the elastic acoustic waves needs to meet the requirement of residual stress reduction and homogenization without damaging the material of the metal frame. The energy superposition of the elastic acoustic waves injected from multiple directions can be realized by adjusting the phase. The injection duration in the single round needs to be determined, in order to avoid the damage to the material of the metal frame caused by the elastic acoustic waves injected for a long time in the single round. The injection duration of the elastic acoustic waves is adjusted based on an intensity of the elastic acoustic waves injected to the position(s) to be controlled.

From the above, the injection duration of the elastic acoustic waves in each round is controlled to achieve the transient reduction and homogenization of the residual stress. The material of the metal frame recovers its original material property without reducing its yield strength and component strength after the injection of elastomeric acoustic waves is stopped. The reduction and homogenization of residual stress of the metal frame can be performed for multiple rounds when the stress at the position(s) to be controlled cannot be eliminated by the elastomeric acoustic waves injected in the single round. The energy required for the transient reduction and homogenization of residual stress is much lower than the energy required for the stress relief annealing.

In summary, based on the residual stress distribution of the metal frame, the present disclosure determines the number of injection directions and the corresponding injection direction(s), the excitation scheme, and the working parameters of the high-energy elastic acoustic waves and controls the working parameters such as the frequency, amplitude, phase, and the injection duration of each of the high-energy elastic acoustic waves in the single round, so that high-energy focusing regions are formed on the surface, subsurface, or inner portion of the metal frame, so as to achieve the reduction and homogenization of the residual stress of the metal frame in an efficient, lossless and rapid manner.

Figure 1:
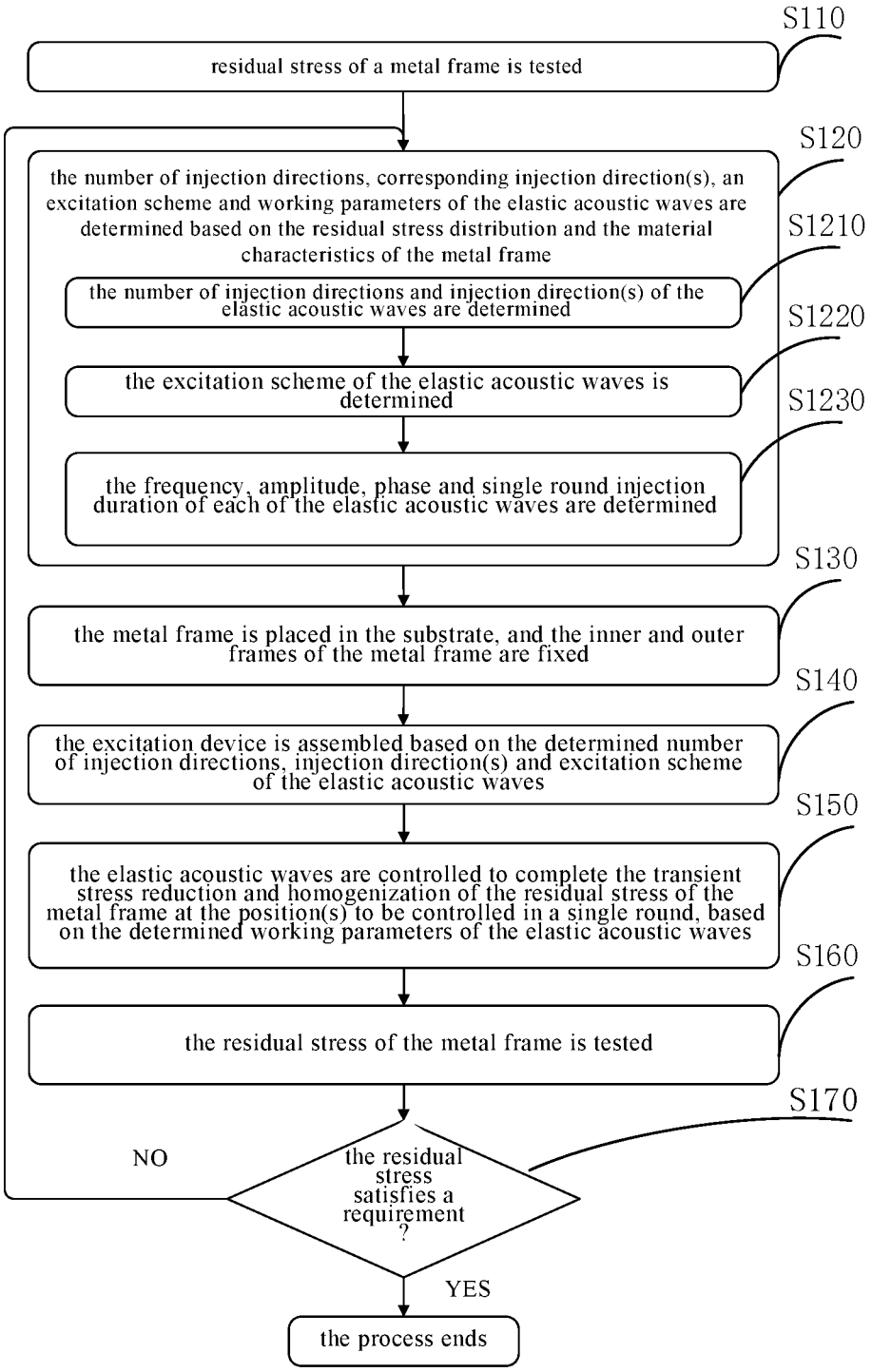
FIG. 1 is a flow chart of the method according to an embodiment of the present disclosure.

Reference numerals are as follows:

1—a substrate, 2—a cross compaction block, 3—elastic acoustic waves, 4—a metal frame, 5—vacancy defects and 6—grain boundary dislocation.

DETAILED DESCRIPTION OF THE EMBODIMENTS

The disclosure provides a method for reducing and homogenizing residual stress of a metal frame based on elastic acoustic waves.

The method according to an embodiment of the disclosure will now be described in detail with reference to the examples shown in the accompanying drawings.

As shown in FIG. 1, the present disclosure provides a method for reducing and homogenizing residual stress of a metal frame based on elastic acoustic waves, which comprises steps S110-S170.

Figure 3:
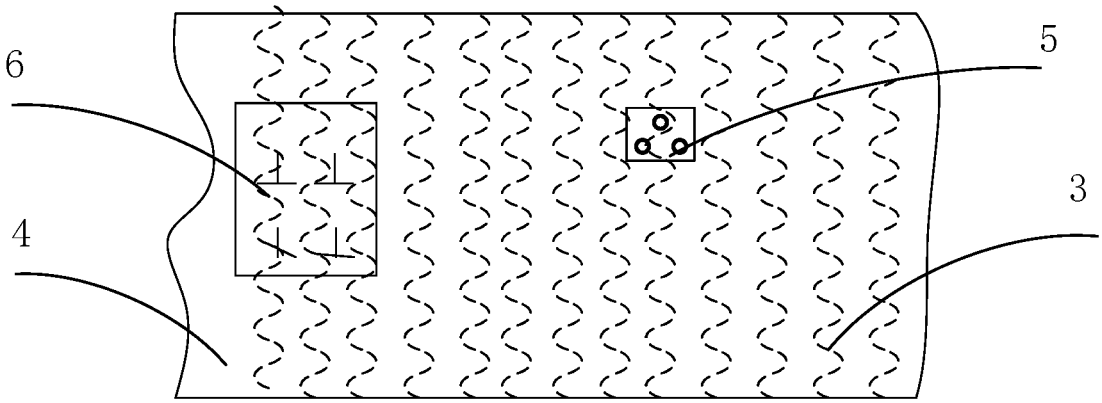
FIG. 3 is a schematic diagram of the distribution of residual stress inside the metal frame.

In the step S110, residual stress of a metal frame 4 is tested. As shown in FIG. 3, the rectangular frame region shown in the metal frame 4 is a stress concentration region which is formed due to the aggregation of grain boundary dislocations 6 and vacancy defects 5, and the like caused during the processing of the metal frame 4.

The metal frame 4 is subjected to a plurality of processing procedures. The testing of the residual stress can be performed after each procedure is completed, and the reduction and homogenization of the residual stress can be performed in-situ. The test, reduction and homogenization of the residual stress can also be performed off-situ after all of the procedures are completed.

In the step S120, the number of injection directions, corresponding injection direction(s), an excitation scheme and working parameters of the elastic acoustic waves 3 are determined based on the residual stress distribution of the metal frame 4 and the material characteristics of the metal frame 4. The working parameters of the elastic acoustic wave 3 comprise a frequency, an amplitude, a phase and an injection duration in a single round. The step S120 comprises the following steps S1210-S1230.

In the step S1210, the number of injection directions and the corresponding injection direction(s) of the injected elastic acoustic waves 3 are determined based on the stress distribution of the metal frame 4.

The injection direction(s) of the elastic acoustic waves 3 is aligned with position(s) to be controlled of the residual stress of the metal frame 4, and the elastic acoustic waves 3 are selected to be injected from more than one direction when any one of the following conditions is met: there is more than one position to be controlled for the residual stress of the metal frame 4, and one injection direction cannot cover the positions to be controlled of the total residual stress; and the residual stress of the metal frame 4 at a single position to be controlled requires the elastic acoustic waves to be injected from more than one direction.

In the step S1220, the excitation scheme of the injected elastic acoustic waves 3 is determined based on the residual stress distribution of the metal frame 4 and the material characteristics of the metal frame 4.

When the excitation device for the elastic acoustic waves 3 is an ultrasonic vibrator, an ultrasonic horn of the ultrasonic vibrator is selected based on an acoustic velocity of the metal frame 4, a radius of an end face of the ultrasonic horn is 20-80 mm, and it is determined whether a tool cap needs to be added so as to enlarge the adaptive area, on the basis of a size of the position(s) to be controlled of the residual stress of the metal frame 4.

When the excitation device for the elastic acoustic waves 3 is a fluid coupling excitation device, the injection direction of the elastic acoustic waves 3 can be adjusted to facilitate the formation of guided wave(s) at the position(s) to be controlled of the metal frame 4 by adjusting the injection directions of the elastic acoustic waves 3, so as to achieve energy superposition, and the strength of the guided wave(s) is determined by the energy of the elastic acoustic waves 3 injected from multiple directions and the acoustic impedance of the metal frame 4.

In the step S1230, the frequency, amplitude, phase and injection duration of each of the injected elastic acoustic waves 3 are determined.

The frequency of the elastic acoustic waves 3 ensures that the acoustic velocity of the material of the metal frame 4 is matched with that of the excitation device. The amplitude can not only ensure the reduction and homogenization effects of the residual stress of the metal frame 4, but also does not cause the deformation of the metal frame 4. The phase is adjusted so that the injected elastic acoustic waves 3 can achieve the energy superposition of the elastic acoustic wave 3 at the position(s) to be controlled.

The injection duration of the elastic acoustic waves 3 in a single round is determined based on the intensity of the elastic acoustic waves 3 injected into the position(s) to be controlled. The injection duration in each round is controlled to achieve the transient reduction and homogenization of the residual stress of the metal frame 4 for multiple rounds. After the injection of the elastic sound waves 3 is stopped, the material of the metal frame 4 restores its original material properties without reducing its yield strength and component strength. The energy required for the transient reduction and homogenization of residual stress is much lower than the energy for stress relief annealing.

Usually, the ultrasonic frequency is 5 KHz-50 KHz, the output power is 10-400W, and the single injection duration is 20-40 min.

In the step S130, the metal frame is placed in the substrate 1, and the inner and outer frames of the metal frame 4 are fixed.

Figure 2:
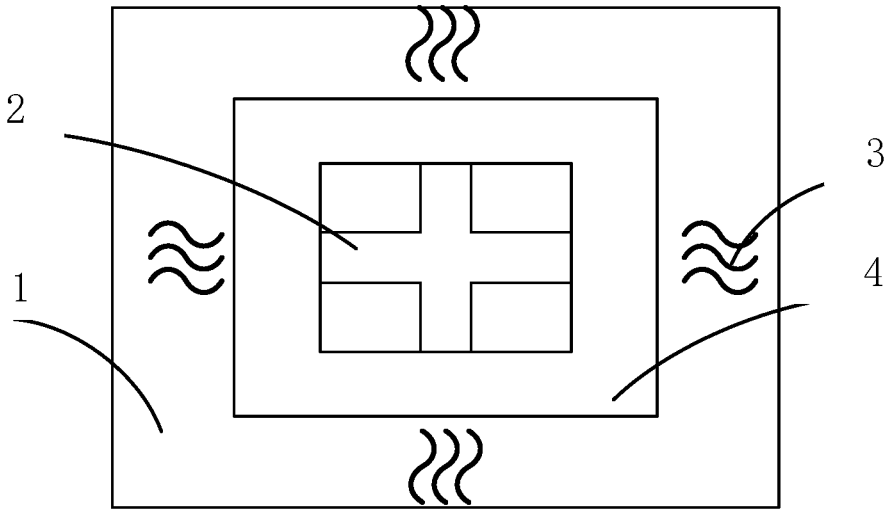
FIG. 2 is a schematic view of fixing a metal frame.

The metal frame 4 may be deformed during the injection of the elastic acoustic waves 3, and the inner and outer frames of the metal frame 4 are fixed to prevent such deformation. As shown in FIG. 2, the inner frame of the metal frame 4 is in a tight interference fit with a cross compression block 2, and the outer frame matches the inner frame of the substrate 1 or is in close contact with the front end of the ultrasonic vibrator.

In the step S140, the excitation device is assembled based on the determined number of injection directions, injection direction(s) and excitation scheme of the elastic acoustic waves 3.

Each injection direction requires the installation of one excitation device. The front end of the ultrasonic vibrator or the tool cap is in close contact with the outer frame of the metal frame 4, when the ultrasonic vibrator device is used as the excitation device. The excitation device is assembled to meet the requirement that the injection direction of the subsequent elastic acoustic wave 3 can be adjusted, when the fluid coupling excitation device is used.

In the step S150, the injected elastic acoustic waves 3 are controlled to complete the transient stress reduction and homogenization of the residual stress of the metal frame 4 at the position(s) to be controlled in a single round, based on the determined working parameters of the elastic acoustic waves 3.

The frequency and amplitude of the elastic acoustic waves 3 are set, the excitation device is turned on, the elastic acoustic waves 3 are injected into the metal frame 4 from at least one direction, the phases of the injected elastic acoustic waves 3 are controlled, the injection direction of the elastic acoustic waves 3 is simultaneously adjusted so as to form guided waves at the position(s) to be controlled when the fluid coupling excitation device is used, and the transient reduction and homogenization of the residual stress of the metal frame 4 at the position(s) to be controlled in a single round is completed within the designed single round injection duration.

The energy of the elastic acoustic waves 3 is directed to the regions of the residual stress distribution of the metal frame 4 such as grain boundary dislocation 6, vacancy defect 5 and the like, and is absorbed in the regions, so that the lattice distortion of the regions with overhigh residual stress of the material is induced to recover a free elastic state, so as to release the residual stress.

In the step S160, the residual stress of the metal frame 4 is tested. The residual stress of the metal frame 4 is tested after the reduction and homogenization is finished in each round.

In the step S170, it is determined whether the residual stress of the metal frame 4 satisfies a requirement. If the requirement is satisfied, the process of reducing and homogenizing the residual stress of the metal frame 4 ends. If the requirement is not satisfied, then the process returns to the step S120 to determine a new scheme for residual stress reduction and homogenization based on the new residual stress distribution.

In summary, based on the residual stress distribution and the material characteristics of the metal frame 4, the present embodiment designs the number of injection directions and corresponding injection directions, the excitation scheme, and the working parameters of the elastic acoustic waves 3 and controls the working parameters such as the frequency, amplitude, phase, and single round injection duration of at least one high-energy elastic acoustic wave to form high-energy focusing regions on the surface, sub-surface, or inner portion of the metal frame 4, so as to achieve the reduction and homogenization of the residual stress of the metal frame 4 in an efficient, lossless, and rapid manner. The energy of the elastic acoustic waves 3 acting on the metal frame 4 can reduce transiently the yield strength of the material of the metal frame 4 during the stress deformation process, improve the plastic forming capability and speed of the material, and achieve the transient softening effect, and the required energy is far lower than the energy required for the stress relief annealing. After the removal of the high-energy elastic acoustic waves 3, the material recovers its original material characteristics without reducing its yield strength and the component strength. The method in the present embodiment is thus an efficient and non-destructive method for reducing and homogenizing residual stress.

The above descriptions are only used to explain the preferred embodiments of the present disclosure and are not intended to limit the present disclosure. Any modification, equivalent replacement, improvement, etc. made within the spirit and principle of the present disclosure shall be included within the protection scope of the present disclosure.

What is claimed is:

1. A method for reducing and homogenizing residual stress of a metal frame using elastic acoustic waves, comprising:

determining an injection scheme of elastic acoustic waves using residual stress distribution and material characteristics of a metal frame, wherein the injection scheme at least comprises the number of injection directions, corresponding injection direction(s), an excitation scheme and working parameters of the elastic acoustic waves, wherein the working parameters include at least one of a frequency, an amplitude, a phase and an injection duration;

placing the metal frame in a substrate and fastening inner and outer frames of the metal frame;

assembling an excitation device for the elastic acoustic waves using the determined excitation scheme of the elastic acoustic waves; and injecting the elastic acoustic waves into the metal frame from at least one direction to perform reduction and homogenization of residual stress of the metal frame, wherein the injected elastic acoustic waves have the determined working parameters, wherein determining the injection scheme of the elastic acoustic waves further includes:

setting the number of injection directions of the elastic acoustic waves and the corresponding injection direction(s) of the elastic acoustic waves using the residual stress distribution of the metal frame, wherein the injection direction(s) of the elastic acoustic waves is aligned with position(s) to be controlled of the residual stress of the metal frame, and the number of injection directions of the elastic acoustic waves is set to be larger than one when there is more than one position to be controlled for the residual stress of the metal frame, and one injection direction cannot cover the positions to be controlled of the total residual stress, or the residual stress of the metal frame at a single position to be controlled requires the elastic acoustic waves to be injected from more than one direction;

setting the excitation scheme of the elastic acoustic waves using the residual stress distribution of the metal frame and the material characteristics of the metal frame, wherein when an excitation device for the elastic acoustic waves is an ultrasonic vibrator, an ultrasonic horn of the ultrasonic vibrator matching an acoustic velocity of the metal frame is selected and a tool cap is added to an end face of the ultrasonic horn if a size of the position(s) to be controlled of the residual stress of the metal frame is larger than a certain size, and when the excitation device for the elastic acoustic waves is a fluid coupling excitation device, the injection direction of the elastic acoustic waves can be adjusted to facilitate the formation of guided wave(s) at the position(s) to be controlled of the metal frame by adjusting the injection directions of the elastic acoustic waves, and the strength of the guided wave(s) is determined by the energy of the elastic acoustic waves injected from multiple directions and the acoustic impedance of the metal frame; and setting the working parameters of the elastic acoustic waves, wherein a set frequency of each of the elastic acoustic waves ensures that the acoustic velocity of the material of the metal frame is matched with that of the excitation device, a set amplitude of each of the elastic acoustic waves can ensure the reduction and homogenization effects of the residual stress of the metal frame and does not cause the deformation of the metal frame, and a set phase of each of the elastic acoustic waves is adjusted so that the injected elastic acoustic waves can achieve the energy superposition of the elastic acoustic waves at the position(s) to be controlled.

2. The method according to claim 1, wherein after performing the reduction and homogenization, the method further comprising:

determining the residual stress distribution of the metal frame when the residual stress of the metal frame is still larger than a certain value; and performing again the steps of determining the injection scheme, the assembling and the injecting.

3. The method according to claim 1, wherein the injection duration of the elastic acoustic waves is adjusted, and wherein the injection duration decreases as an intensity of the elastic acoustic waves injected into the position(s) to be controlled increases.

* * * * *